US006353719B1

(12) United States Patent
Lee

(10) Patent No.: US 6,353,719 B1
(45) Date of Patent: Mar. 5, 2002

(54) METHOD AND APPARATUS OF CONTROLLING IMAGE FIXING TEMPERATURE OF IMAGE FORMING UNIT IN A PRINTER

(75) Inventor: Bong-Hee Lee, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/686,935

(22) Filed: Oct. 12, 2000

(30) Foreign Application Priority Data

Feb. 21, 2000 (KR) ..... 00-8154

(51) Int. Cl.[7] ..... G03G 15/20
(52) U.S. Cl. ..... 399/69
(58) Field of Search ..... 399/67, 69, 70, 399/81, 320, 328; 219/216

(56) References Cited

U.S. PATENT DOCUMENTS

| | | | | |
|---|---|---|---|---|
| 4,878,092 A | * | 10/1989 | Arai | 399/70 |
| 4,899,140 A | * | 2/1990 | Ito et al. | 399/81 X |
| 5,109,255 A | | 4/1992 | Nishikawa et al. | 399/70 |
| 5,386,272 A | | 1/1995 | Nakazato | 399/33 |
| 5,402,211 A | | 3/1995 | Yoshikawa | 399/331 |
| 5,575,942 A | | 11/1996 | Watanabe | 219/469 |
| 5,682,576 A | | 10/1997 | Sakai et al. | 399/69 |
| 5,729,814 A | | 3/1998 | Suzuki et al. | 399/333 |
| 5,742,865 A | | 4/1998 | Yajima et al. | 399/43 |
| 6,011,938 A | * | 1/2000 | Toizumi | 399/69 |
| 6,072,156 A | | 6/2000 | Matsuo et al. | 219/216 |
| 6,087,641 A | * | 7/2000 | Kinouchi et al. | 399/67 X |
| 6,096,995 A | | 8/2000 | Toyota et al. | 219/216 |
| 6,148,163 A | * | 11/2000 | Ito | 399/67 |

FOREIGN PATENT DOCUMENTS

JP 54-092746 * 7/1979

* cited by examiner

*Primary Examiner*—Sandra Brase
(74) *Attorney, Agent, or Firm*—Robert E. Bushnell, Esq.

(57) ABSTRACT

An apparatus and method of controlling the temperature of an image fixing unit having a developer fixed on a recording medium under a predetermined temperature in an image forming apparatus is provided. The temperature of the image fixing unit is set to one of a plurality of different temperatures stored in a controller of the image forming apparatus depending on an printing operation status of the image forming apparatus. The image fixing unit is heated and warmed-up to a predetermined ready temperature. If a print command is not received until the warm-up is completed, the ready temperature is maintained. The printing operation starts upon completion of the warm-up if the print command is received before the warm-up is completed. The temperature of the image fixing unit for the printing operation is set to a normal temperature during printing a first sheet, and the temperature of the image fixing unit for the printing operation of a second sheet of paper is set to a higher temperature higher than the normal temperature. If the print command is received while the ready temperature is maintained after the warm-up, the printing operation is performed with a lower temperature lower than the normal image fixing temperature.

19 Claims, 5 Drawing Sheets

METHOD AND APPARATUS OF CONTROLLING IMAGE FIXING TEMPERATURE OF IMAGE FORMING UNIT IN A PRINTER

CLAIM FOR PRIORITY

This application makes reference to, incorporates the same herein, and claims all benefits accruing under 35 U.S.C. §119 from an application for *Fixing Temperature Control Method in Electrophotograph Image Forming Apparatus* earlier filed in the Korean Industrial Property Office on Feb. 21, 2000, and thereby duly assigned Ser. No. 2000-8154, a copy of which application is annexed hereto.

BACKGROUND OF THE INVENTION

1. Field of the Invention

The present invention relates to a method and apparatus of controlling an image fixing temperature of an image forming unit in a laser beam printer, and particularly, to a method and apparatus of controlling an image forming unit of a laser beam printer and selecting one of a plurality of image fixing temperatures of the image forming unit depending on a period of time of a warm-up state and a ready state of the image fixing unit of the printer.

2. Description of the Related Art

An image forming unit in a copier, such as a laser beam printer or a plain paper facsimile machine, has been used for fixing a developer developed on a sheet of paper after heated to an image fixing temperature by a heater attached to the image forming unit. An image is formed by the developer on the paper using an electrophotographic developing method while the sheet containing the developer passes through the heated image forming unit. The heater of the image forming unit is controlled by a controller to maintain the image fixing temperature of the image forming unit for a next printing operating.

The image fixing temperature, however, is fixed to a certain temperature regardless of a period of time to warm-up the image forming unit and maintain a warm-up temperature until a printing operation starts. If the printing operation performs in a very short period of time after the temperature of the image fixing unit is increased to the warm-up temperature or the warm-up temperature is increased to a ready temperature, the quality of the printing operation is lowered because the image fixing unit is not fully but partially increased to the warm-up temperature or the ready temperature. The developer is partially fixed on the sheets of paper and the partially fixed developer becomes deteriorated because the temperature of the image fixing unit for fixing the developer on the sheet of paper is not uniformly maintained by repeated printing operations when the printing operation is performed shortly after the temperature of the image fixing unit is increased to the warm-up temperature or the warm-up temperature is increased to the ready temperature.

SUMMARY OF THE INVENTION

It is an object of the present invention to provide an apparatus and method able to prevent quality of an image fixed on a sheet of paper from deteriorating due to failure of maintaining of a proper image fixing temperature for each printing operation.

It is another object to provide an apparatus and method able to improve performance of an image fixing process in an image fixing unit of a printer.

It is yet another object to provide an apparatus and method able to provide a plurality of printing temperatures enabling an image fixing unit to properly fix a developer on each sheet of paper in each printing operation.

It is still another object to provide an apparatus and method able to select one of a plurality of temperatures in response to a period of time taken to maintain a ready temperature or a warm-up temperature for each printing operation.

It is a further object to provide an apparatus and method able to control a temperature of an image fixing unit in dependence upon a period of time between a printing start time and a warm-up start time or a ready start time in a printer.

It is also an object to provide an apparatus and method able to maintain an image fixing unit with a predetermined temperature suitable to fix a developer on consecutive sheets of paper.

These and other objects may be achieved by providing an apparatus and method of controlling an image fixing temperature in an image forming apparatus. The apparatus includes a controller storing a plurality of printing temperatures as the image fixing temperature, such as a normal temperature, a first temperature lower than the normal temperature, a second temperature higher than the normal temperature. The controller controls a heater attached to the image fixing unit with one optimum printing temperature out of the stored printing temperatures in dependence upon a period of time between a printing start time and a warm-up start time or a ready start time. The heater is turned on and off by the controller to maintain the optimum printing temperature. When a warm-up starts, the temperature of the image fixing unit is increased to a predetermined ready temperature. If a print command is not received until the warm-up is completed, the ready temperature is maintained. A printing operation starts upon completion of the warm-up even if the print command is received before the warm-up is completed.

In the method of controlling the image fixing temperature of the image fixing unit, when the printing command is received before the warm-up is completed, a normal temperature is set to the image fixing unit for fixing the image on a first sheet of paper, a first temperature is set to the image fixing unit for fixing the image on a second sheet of paper following the first sheet after a first sheet of paper is printed. The first temperature is higher than the normal temperature. If the print command is received while the ready temperature is maintained after the warm-up, a normal temperature is set to the image fixing unit for fixing the image on a sheet of paper. A second image fixing temperature is set to the image fixing unit for fixing the image on a sheet of paper if the print command is received in a predetermined period of time after the ready temperature is maintained after the warm-up. The second image fixing temperature is lower than the normal image fixing temperature.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
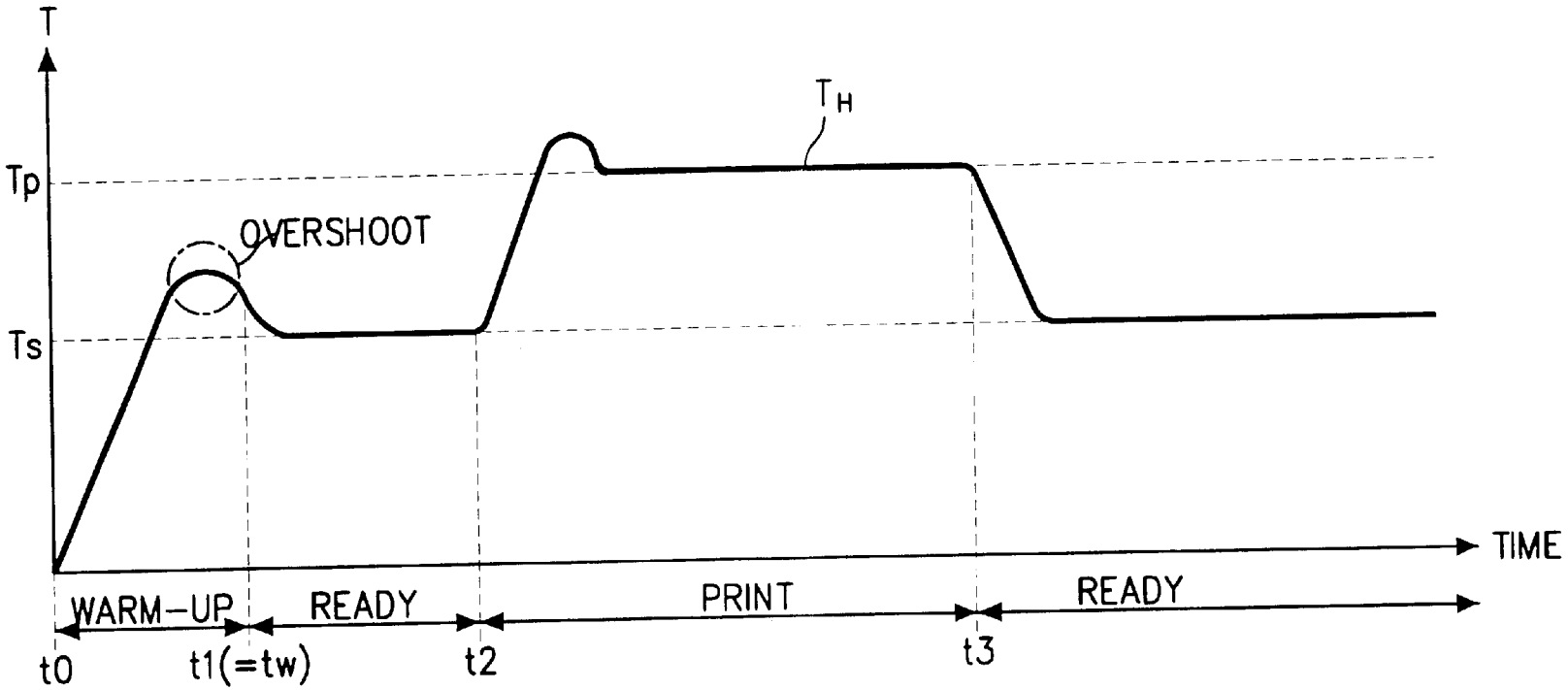
FIG. 1 is a timing diagram showing an image fixing temperature of an image fixing unit in a printer.

Referring now to the drawings, in a method of controlling an image fixing unit in a copier, a temperature of the image fixing unit varies in response to a controller and includes two stages: a ready temperature for a ready state and a printing or fixing temperature for a printing operation of the image fixing unit. A timing diagram of the image fixing temperature shown in FIG. 1 illustrates the ready temperature and the printing temperature after the copier is turned on or released from a sleep mode at time t0, the controller of the copier turns on the heater and increases a temperature Th of the image fixing unit to a ready temperature Ts. This operation is called a warm-up operation of the image fixing unit, and a period of a warm-up time tw is usually 40–50 seconds. Upon completion of the warm-up at time t1, the controller awaits receipt of a print command from an external device of the copier, repeating turning on/off of the heater to maintain the ready temperature Ts. The sleep mode refers to a mode where the image fixing unit is off until a printing operation resumes if the printing operation is not performed for a predetermined period of time.

Upon receipt of the print command at t2 in the ready state, the temperature Ts of the image fixing unit is increased from the ready temperature Ts to the print temperature Tp by turning on the heater and repeats turning on/off of the heater to maintain the printing temperature Tp. If the printing operation is completely performed, the printing temperature Th is decreased to the ready temperature Ts by turning off the heater, and then the ready temperature Ts maintains. An overshoot exists when the temperature of the image fixing unit is heated to the ready temperature Ts and the printing temperature Tp. An undershoot may also exist. The overshoot and undershoot disappear as time goes and then the temperature Th of the image fixing unit becomes stabilized.

Figure 2:
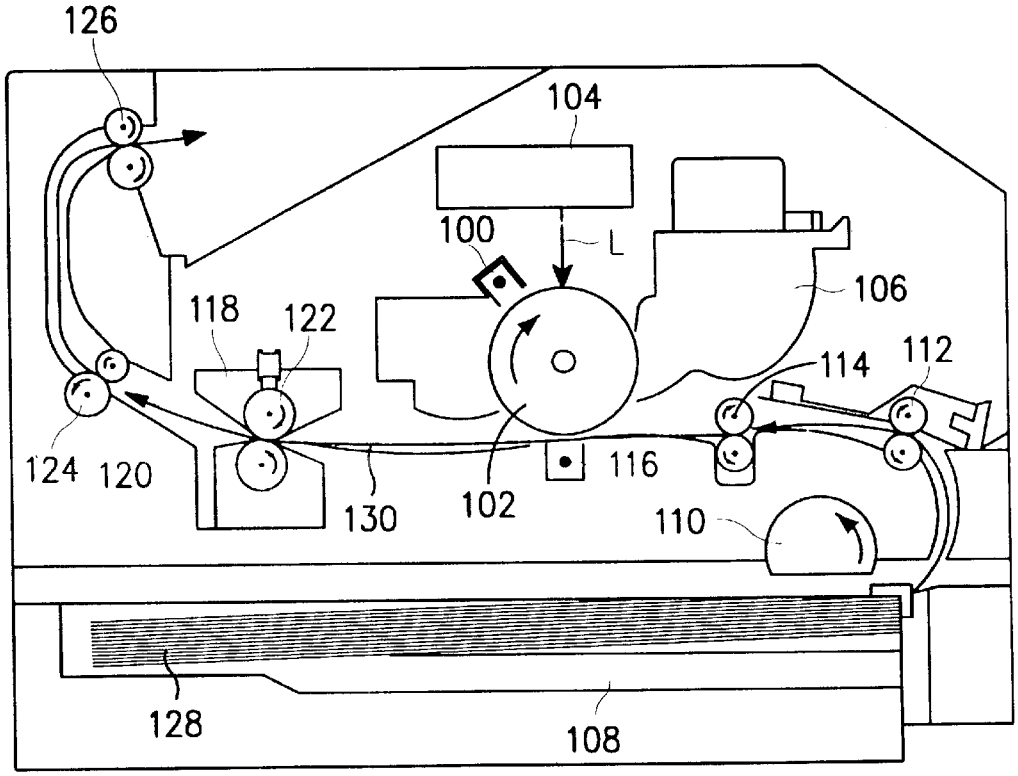
FIG. 2 is a side view showing a printer having a printing mechanism using a method of controlling a plurality of image fixing temperatures of an image fixing unit according to the present invention.

FIG. 2 illustrates an engine mechanism of a Laser Beam Printer (LBP) using a method of controlling an image fixing unit with an image fixing temperature. Each of sheets of paper 128 stacked on a paper cassette 108 is picked up by a pick-up roller 110, transferred along a paper transfer path 130, printed by a photosensitive drum 102 and an image fixing unit 118, and then discharged outside the printer by discharge rollers 124, 126. This operation will be described in terms of the electrophotographic development process, which is used in the copier, charging a photosensitive drum, exposing photosensitive drum 102 on a laser beam to form an electrostatic image on photosensitive drum 102, developing an image on photosensitive drum 102, transcribing the developed image on a sheet of paper, and fixing the developed image on the paper while the paper containing the developed image passes through the image fixing unit.

Photosensitive drum 102 is charged by a charger 100 so that charges are uniformly formed on a surface of photosensitive drum 102. One of the sheets of paper 128 is picked up from paper cassette 108 by pick-up roller 110 and transferred to register rollers 114 by feeding rollers 112. Then, an electrostatic image is formed on a surface of photosensitive drum 102 by exposing it by an exposure device, laser scanner unit (LSU) 104. In operation, LSU 104 projects a laser beam L onto photosensitive drum 102 according to image data to be printed. Paper 128 transferred to register rollers 114 has a leading edge aligned to photosensitive drum 102 and then starts to be transferred to a transcriber 116 in synchronization with the start of the exposure. The electrostatic image formed on photosensitive drum 102 is changed to a visible image through development using a toner as a developer provided from a developing unit 106. The toner attached to photosensitive drum 102 is transcribed onto the paper 128 by transcriber 116 and transferred to an image fixing unit 118 with a heating roller 120 and a pressure roller 122. Then, the toner transcribed on paper 128 is fixed by heat of heating roller 120 and the pressure of pressure roller 122. Discharge rollers 124 and 126 discharge the fixed paper 128 to the outside of the printer. Thus, the paper sheet 128 is completely printed.

Heat roller 120 is cylindrical and has a heater lamp installed inside the cylindrical heat roller 120. To achieve good fixing on the paper from image fixing unit 118, the temperature of image fixing unit 118 should be optimal. This optimal temperature is usually called a fixing temperature or a printing temperature which depends on a melting temperature of a developer and a paper thickness. The fixing temperature varies depending upon when a printing command is input by a user or how many pages are printed. The printing command may be input during warm-up, shortly after warm-up, or long after warm-up. The fixing temperature is decided in dependence upon the pages to be printed and a period of time between said printing command is input and when said image fixing unit is warmed up.

Figure 3:
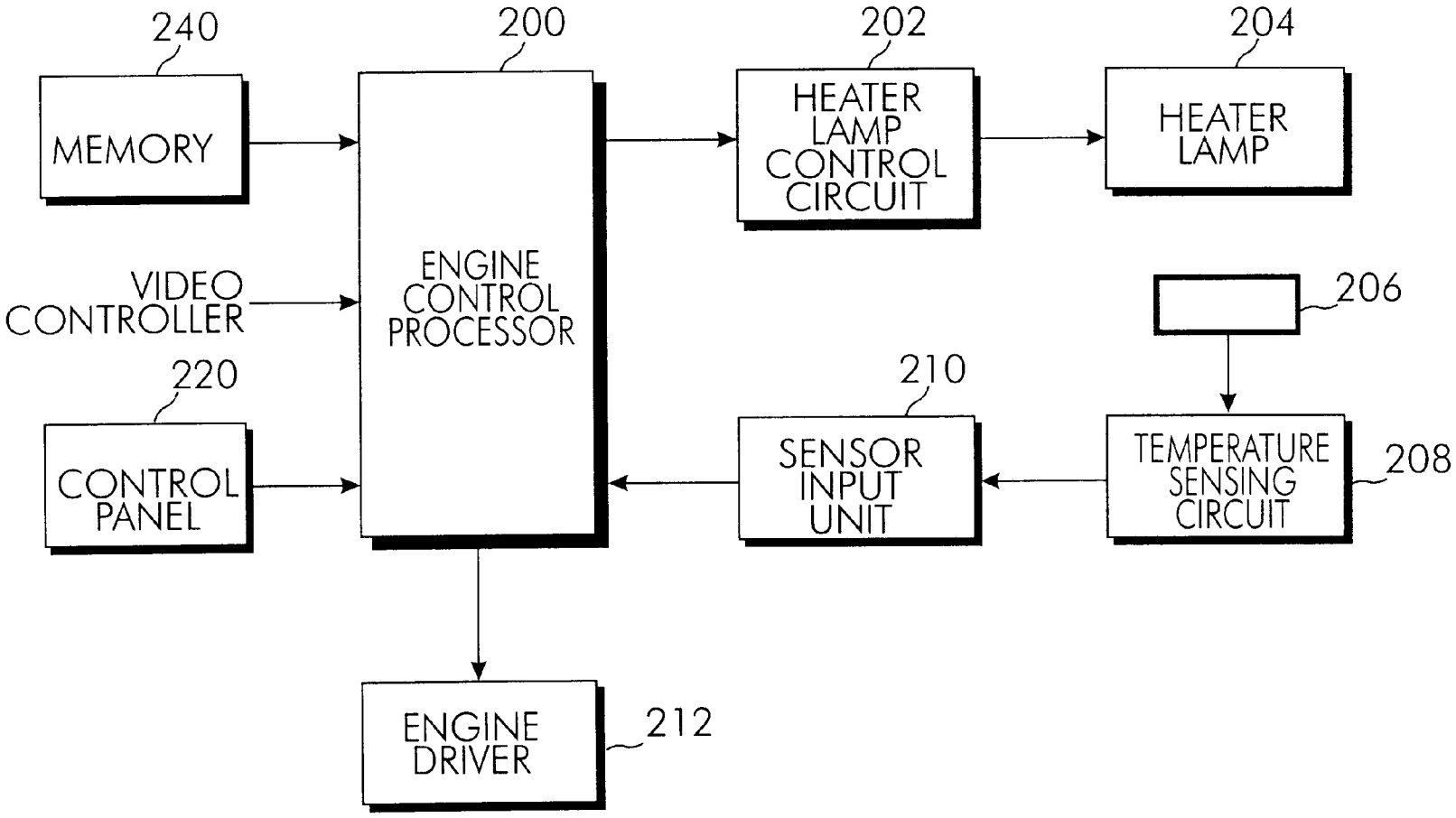
FIG. 3 is a block diagram controlling the image fixing unit with an image fixing temperature in the printer of FIG. 2.

The fixing temperature is controlled by an engine control processor 200 of a printer engine shown in FIG. 3. A LBP is largely comprised of a video controller and the printer engine. The video controller processes image data received from a personal computer (PC) as a host computer and feeds the processed image data to the printer engine. Then, the printer engine controls an engine driver 212 to print an image onto a paper sheet based on the image data received from the video controller. A plurality of fixing temperatures such as a normal temperature, a first temperature lower than the normal temperature, and a second temperature higher than the normal temperature, are stored in a memory 240 contained in or coupled to engine control processor 200, and a control panel 220 is coupled to engine control processor 200 to generate the printing command. Engine control processor 200 may store only a normal temperature in a memory, generates the normal temperature, the first temperature or the second temperature calculated from the normal temperature in response to the period of time, and control the heater such as heat lamp 204 to heat image fixing unit 118 to one of the normal temperature, the first temperature, and the second temperature.

The printing command generated from control panel by the user is fed to engine control processor 200. In response to the printing command, engine control processor 200 controls the temperature of image fixing unit 118 by turning on or off the heat lamp 204 through a heater lamp control circuit 202. In response to when the printing command is input before the warm-up is finished, shortly after the warm-up is finished, long after the warm-up is finished, etc., or whether a second page is printed after a first page is printed, one of the fixing temperature stored in the memory is selected, and engine control processor 200 control the heater and image fixing unit to maintain the one of the fixing temperature. Heater lamp control circuit 202 supplies power to heater lamp 204 in response to an on signal received from engine control processor 200. Then, the temperature of image fixing unit 118 increases due to heat emitted from lamp 204. On the other hand, upon receipt of an off signal received from engine control processor 200, heater lamp control circuit 202 turns off heater lamp 204 by blocking power from heater lamp 204. Then, heater lamp 204 emits heat no longer and the temperature of image fixing unit 118 drops.

Meanwhile, a temperature sensor 206 is provided to heating roller 120. A thermistor exhibiting a negative resistance-temperature characteristic is typically used as temperature sensor 206 which varies in resistance value with the temperature of image fixing unit 118. A temperature sensing circuit 208 connected to temperature sensor 206 applies a signal at a voltage level corresponding to the resistance value of temperature sensor 206 to a sensor input unit 210. Sensor input unit 210 is generally an Analog-to-Digital Converter (ADC) or a comparing circuit for converting the received signal to digital data having a value corresponding to the voltage level of the signal and applying the digital data to engine control processor 200. Engine control processor 200 senses the present temperature of image fixing unit 118 from the output data value of sensor input unit 210 and controls heater lamp 204 through the heater lamp control circuit 202 to set the temperature of image fixing unit 118 to a target temperature. If the current temperature of image fixing unit 118 is higher than the target temperature, engine control processor 200 turns off heater lamp 204 to thereby decrease the temperature of image fixing unit 118. If the current temperature of image fixing unit 118 is lower than the target temperature, engine control processor 200 turns on heater lamp 204 to thereby increase the temperature of image fixing unit 118.

In general, the temperature of image fixing unit 118 is controlled in two stages: a ready temperature and a printing temperature. Some time is taken to heat image fixing unit 118 at room temperature to a printing temperature using heater lamp 204. This explains why image fixing unit 118 is preheated to rapidly reach the print temperature at the start of an actual print operation. The temperature of image fixing unit 118 in a ready state without printing by the engine is defined as a ready temperature. That is, the ready temperature is an intermediate temperature of image fixing unit 118 which is set to facilitate a rapid increase to the printing temperature upon receipt of a print command from a host computer like a PC. For controlling the ready and the printing temperatures, a temperature sensed by a sensor attached to image fixing unit 118 is compared to data stored in the controller, and the heater is turned on and off in response to the comparison of the data and the sensed temperature.

Figure 4:
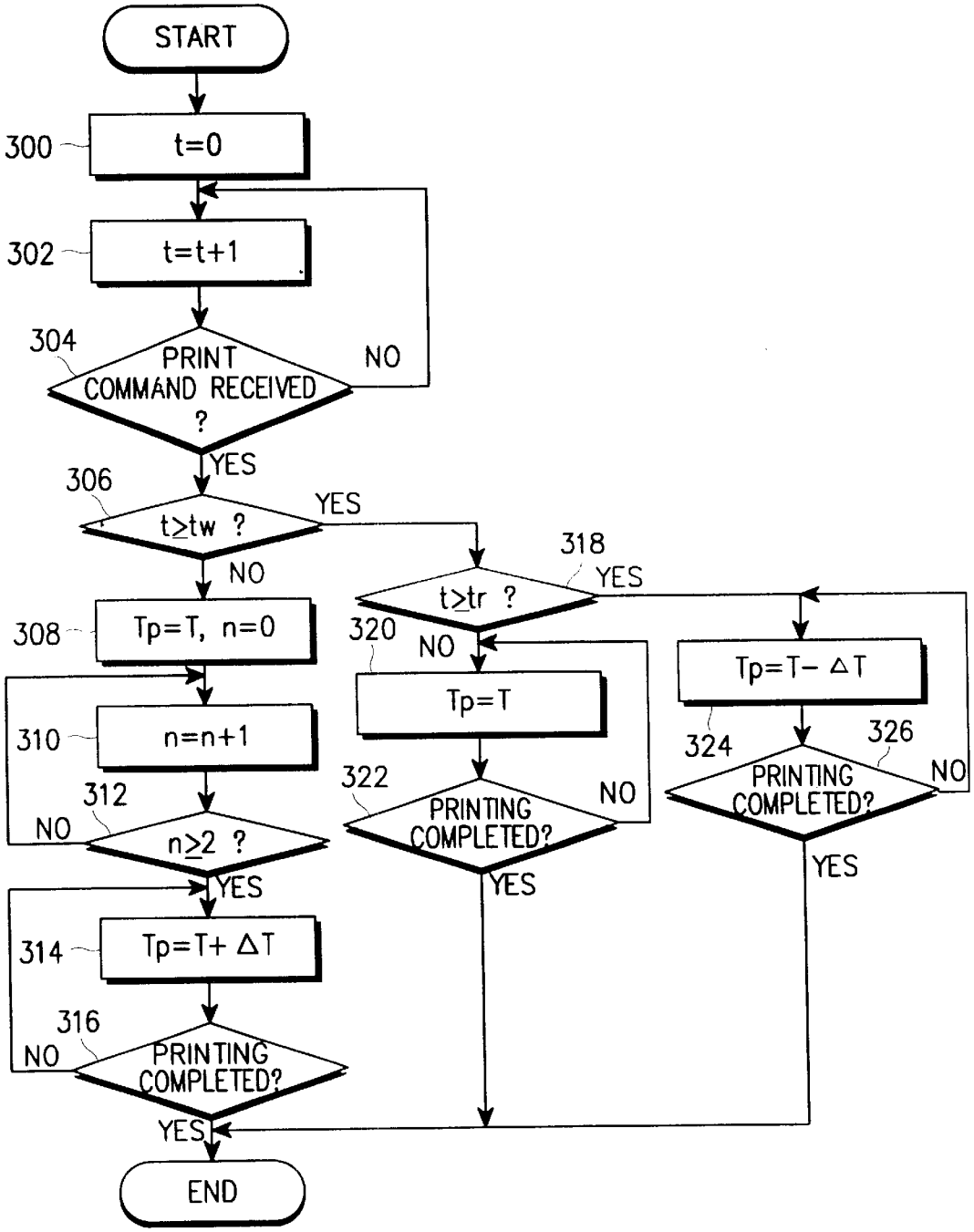
FIG. 4 is a flowchart illustrating a method of controlling the image fixing unit with a plurality of image fixing temperatures according to the present invention.

FIG. 4 is a flowchart illustrating a fixing temperature controlling method according to an embodiment of the present invention. In FIG. 4, the operation of engine control processor 200 in the LBP shown in FIGS. 2 and 3 is executed in steps 300 to 326. In step 300, the engine control processor 200 sets time t to a value 0 and starts to check time passage from t. Ts is maintained if a print command is not received after Ts is set to a target temperature, and the temperature of image fixing unit 118 is increased to Ts. If power is on or a sleep mode is released, engine control processor 200 awaits receipt of the print command while increasing t in steps 302 and 304.

Upon receipt of the print command in the above state, engine control processor 200 compares t with a first predetermined time tw in step 306. If t is smaller than tw, the procedure goes to step 308. If t is not smaller than tw, engine control processor 200 compares t with a second predetermined time tr in step 318. If t is smaller than tr, the procedure goes to step 320 and otherwise, it goes to step 324.

If t is smaller than tw in step 306, which implies that the print command has been received before the warm-up is completed and printing is to be started shortly after the warm-up, the printing operation is performed with a first printing temperature Tp as a normal fixing temperature T, and the number n of pages to be printed set to 0 in step 308, n is increased by 1 in step 310, and it is determined whether n is 2 or not in step 312. If n is 2 in step 312, the printing operation is performed with Tp set to a value T+ΔT by adding T to ΔT, which is higher than T until the printing is completed in steps 314 and 316. If n is not 2 in step 312, which implies that the first page is under printing, the engine control processor 200 controls image fixing unit 118, maintaining Tp as T. After the first page is printed completely, the printing operation is over if no more pages are to be printed and the ready state is entered.

Therefore, if overshoot occurs immediately after a warm-up the first page is printed with the normal printing temperature Tp equal to T, and the other next pages are printed with Tp set to a value T+ΔT, which is higher than T.

On the other hand, if t is not smaller than tw in step 306, which implies that the print command has been received in the ready state after the warm-up, t is compared with tr in step 318. If t is smaller than tr in step 318, which implies that the print command has been received in a time shorter than tr while Ts is maintained after the warm-up, the printing is performed with Tp set to T regardless of the number of pages to be printed until the printing is over in steps 320 and 322.

If t is not smaller than tr in step 318, which implies that the print command has been received after tr elapsed while Ts is maintained after the warm-up and enough heat energy is preserved in image fixing unit 118, the printing is performed with Tp set to a value T−ΔT, which is lower than T regardless of the number of pages to be printed until the printing is over in steps 324 and 326.

Figure 5A:
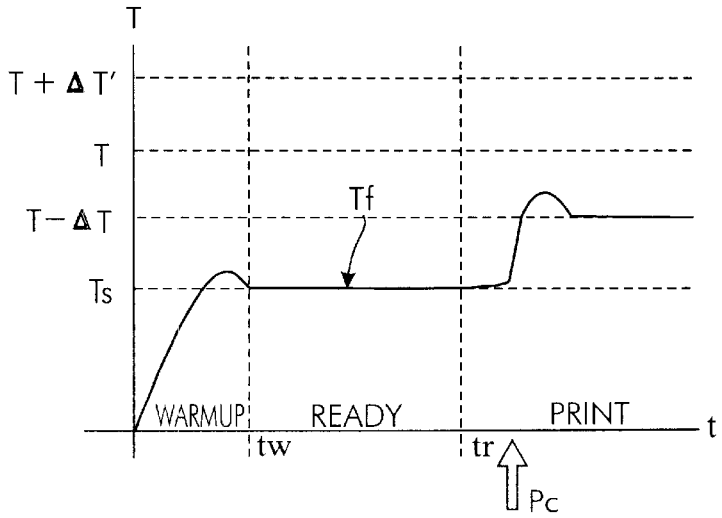
FIGS. 5A, 5B, and 5C are timing diagrams showing a plurality of image fixing temperatures of an image fixing unit according to the present invention.
Figure 5B:
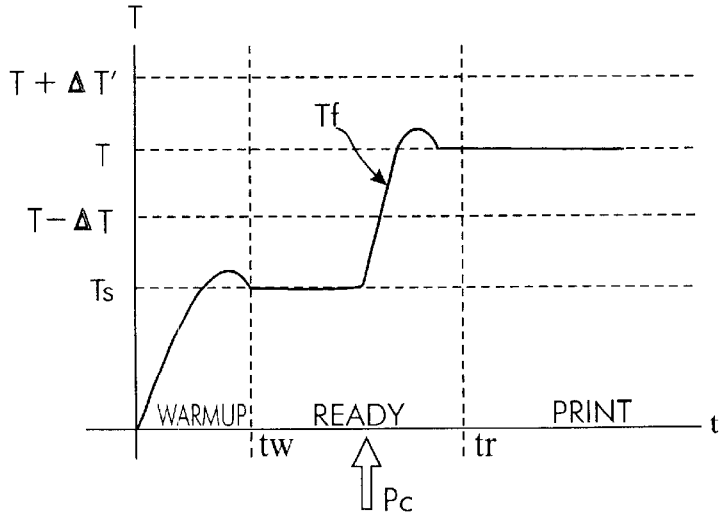
Figure 5C:
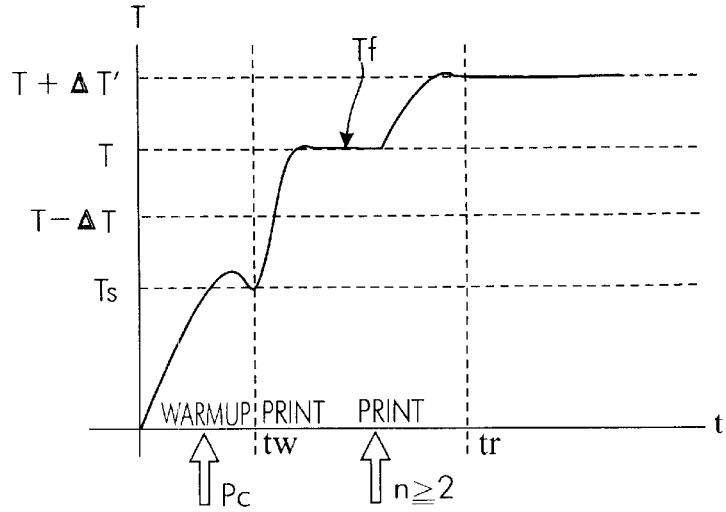

FIGS. 5A through 5C show timing diagrams showing a plurality of image fixing temperatures T, T−ΔT, T+ΔT of an image fixing unit. FIG. 5A shows that the image fixing unit is warmed-up to the ready temperature and maintain the ready temperature. If a printing command Pc is input long after the ready temperature has been maintained and any time after a predetermined period of time tr has been elapsed, the temperature Tf for the printing temperature is set to a first temperature T−ΔT lower than a normal image fixing temperature T. When the printing command is input during maintaining the ready temperature, the temperature Tf for the printing temperature is set to the normal image fixing temperature T as shown in FIG. 5B. If the printing command is input shortly after the image fixing unit 118 has been warmed-up to the ready temperature, the temperature Tf for the printing temperature may be set to a first intermediate temperature between the image fixing temperatures T and T+ΔT. If the printing command is input shortly before a predetermined period of time Tr has been elapsed during maintaining of the ready temperature, the temperature Tf for the printing temperature may be set to a second intermediate temperature between the image fixing temperatures T and T−ΔT.

When the printing command Pc is input before warming-up to the ready temperature, the temperature Tf for printing temperature of a first sheet of paper is set to the normal image fixing temperature T, and the temperature Tf for printing temperature of a second sheet of paper is set to a second temperature T+ΔT higher than the normal image fixing temperature T. For a third sheet of paper, the temperature Tf for printing temperature may be set to a third intermediate temperature between the second temperature T+ΔT and the normal image fixing temperature T. After the second sheet or the third sheet is printed, the temperature Tf for printing temperature may be lowered from the second temperature T+ΔT to the normal image fixing temperature T.

In accordance with the present invention as described above, a fixing temperature is controlled taking into account an operation state at the start of printing by changing the control temperature of the temperature according to the printing start time. Consequently, an optimal fixity is obtained.

While the invention has been shown and described with reference to a certain preferred embodiment thereof, it will be understood by those skilled in the art that various changes in form and details may be made therein without departing from the spirit and scope of the invention as defined by the appended claims. While the embodiment of the present invention has been described in the context of a LBP, the present invention is also applicable to other image forming apparatuses of electrophotographic development which require control of a fixing temperature. Different fixing temperature control operations are applied to the cases that a printing operation starts in a ready state before and after a predetermined time has elapsed, but no distinction can be mad between two cases since a ready temperature is maintained in the ready state.

What is claimed is:

1. An apparatus in a printer, comprising:

an image fixing unit containing a heater, disposed on a paper feeding path to fix a developer on a sheet of paper, exhibiting a range of temperatures while heated by said heater;

a sensor coupled to said image fixing unit, indicating said temperatures of said image fixing unit;

a control panel generating a printing command;

a controller having a memory storing a ready temperature and a plurality of fixing temperatures, said controller coupled to said heater, said sensor, and said control panel, said controller controlling said heater to warm up said image fixing unit to said ready temperature, said controller selecting one of said fixing temperatures depending upon said printing command, said controller controlling said heater for maintain said image fixing unit with said one of said fixing temperatures; and fixing temperatures including said memory storing a normal temperature, a first temperature lower than said normal temperature, and a second temperature higher than said normal temperature.

2. The apparatus of claim 1, said controller selecting one of said normal temperature, said first temperature, and said second temperature in response to a period of time between when said printing command is input and when said image fixing unit is warmed up to said ready temperature.

3. The apparatus of claim 1, said controller selecting said normal temperature when said printing command is input within a period of time after said image fixing unit has been warmed up to said ready temperature, controlling said heater to heat said image fixing unit to said normal temperature.

4. The apparatus of claim 1, said controller selecting said first temperature when said printing command is input after a period of time is elapsed after said image fixing unit has been warmed up to said ready temperature, controlling said heater to heat said image fixing unit to said first temperature.

5. The apparatus of claim 4, said controller selecting a third temperature between said first temperature and said normal temperature in response to selection of a second page to be printed, controlling said heater to heat said image fixing unit to said third temperature.

6. The apparatus of claim 1, said controller selecting said normal temperature when said printing command is input during warming up said image fixing unit, controlling said heater to heat said image fixing unit to said normal temperature after said image fixing unit has been warmed up to said ready temperature.

7. The apparatus of claim 1, said controller selecting said second temperature in response to selection of a second page to be printed, controlling said heater to heat said image fixing unit to said second temperature.

8. The apparatus of claim 7, said controller selecting a third temperature between said normal temperature and said second temperature in response to selection of a third page to be printed, controlling said heater to maintain said image fixing unit with said third temperature.

9. An apparatus in a printer, comprising:

an image fixing unit containing a heater, disposed on a paper path to fix a developer on a sheet of paper, exhibiting a range of temperatures while heated by said heater;

a sensor coupled to said image fixing unit, indicating said temperatures of said image fixing unit;

a control panel generating a printing command; and a controller coupled to said heater, said sensor, and said control panel, controlling said heater to warm up said image fixing unit to a ready temperature, generating one of a normal temperature, a first temperature lower than said normal temperature, and a second temperature higher than said normal temperature in response to a period of time between when said printing command is input and when said image fixing unit is warmed up to said ready temperature.

10. The apparatus of claim 9, further comprising a memory storing said normal temperature, said first temperature, and said second temperature.

11. The apparatus of claim 9, said controller controlling said heater to heat said image fixing unit to said one of said normal temperature, said first temperature, and said second temperature.

12. The apparatus of claim 11, said controller generating said first temperature when said period of time is longer than a predetermined time, generating said normal temperature when said period of time is shorter than said predetermined time.

13. The apparatus of claim 9, said controller generating said normal temperature when said printing command is input before said image fixing unit is warmed up to said ready temperature.

14. The apparatus of claim 13, said controller controlling said heater to heat said image fixing unit to said normal temperature, generating said second temperature in response to selection of a second page to be printed, controlling said heater to heat said image fixing unit to said second temperature.

15. A method of controlling the temperature of an image fixing unit in a printer, comprising the steps of:

providing a heater installed in said image fixing unit, a sensor indicating a range of temperatures of said image fixing unit, a control panel generating a printing command, and a controller coupled to said heater, said sensor, and said control panel and controlling said heater;

allowing said controller to receive from said control panel said printing command;

allowing said controller to control said heater to warm up said image fixing unit to a ready temperature while monitoring said temperatures from said sensor;

making a determination of a period of time between when said printing command is input and when said image fixing unit is warmed up to said ready temperature; and generating one of a normal temperature, a first temperature lower than said normal temperature, and a second temperature higher than said normal temperature in response to said determination.

16. The method of claim 15, further comprising the step of controlling said heater to heat said image fixing unit to said one of said normal temperature, said first temperature, and said second temperature after said image fixing unit has been warmed up to said ready temperature.

17. The method of claim 15, further comprising the step of generating said first temperature when said period of time is longer than a predetermined time and generating said normal temperature when said period of time is shorter than said predetermined time.

18. The method of claim 15, further comprising the step of generating said normal temperature in response to selection of a first page to be printed when said printing command is input before said image fixing unit is warmed up to said ready temperature.

19. The method of claim 18, further comprising the step of:

controlling said heater to heat said image fixing unit to said normal temperature for said first page after said image fixing unit has been warmed up to said ready temperature;

generating said second temperature in response to selection of a second page to be printer; and controlling said heater to heat said image fixing unit to said second temperature for said second page.

* * * * *